US005135190A

United States Patent [19]

Wilson

[11] Patent Number: 5,135,190

[45] Date of Patent: Aug. 4, 1992

[54] ARTICULATING ERGONOMIC SUPPORT SYSTEM

[76] Inventor: Robert W. Wilson, 8010 Woodglen Dr., West Chester, Ohio 45069

[21] Appl. No.: 622,383

[22] Filed: Nov. 30, 1990

Related U.S. Application Data

[63] Continuation-in-part of Ser. No. 602,713, Oct. 23, 1990, abandoned.

[51] Int. Cl.[5] ..... B43L 15/00

[52] U.S. Cl. ..... 248/118.1; 400/715

[58] Field of Search ..... 248/118, 118.1, 118.3, 248/118.5, 133, 371, 425, 176, 183, 309.1; 128/77, 878; 297/194, 411, 412, 416; 400/715; 269/328

[56] References Cited

U.S. PATENT DOCUMENTS

| | | | |
|---|---|---|---|
| 105,001 | 7/1870 | Sanborn | 248/118.5 |
| 2,477,898 | 8/1949 | Rehman | 248/118 |
| 2,732,269 | 1/1956 | Astroff | 269/328 |
| 3,295,518 | 1/1967 | Hazlewood | 248/118 |
| 3,540,719 | 11/1970 | Romney | 269/328 |
| 4,069,995 | 1/1978 | Miller . | |
| 4,546,708 | 10/1985 | Wilburth . | |
| 4,576,351 | 3/1986 | Brink | 248/118 |
| 4,650,249 | 3/1987 | Serber . | |
| 4,688,862 | 8/1987 | Fowler et al. . | |
| 4,709,972 | 12/1987 | La Budde et al. . | |
| 4,784,120 | 11/1988 | Thomas | 248/118 |

FOREIGN PATENT DOCUMENTS 63158 2/1945 Denmark .

OTHER PUBLICATIONS

Ergoarm Brochure-Advertising Brochure Sit-Rite International, Inc.

*Primary Examiner*—David L. Talbott

*Attorney, Agent, or Firm*—John P. O'Banion

[57] ABSTRACT

An articulating ergonomic support apparatus is disclosed for supporting an individual's forearm, wrist, and palm of the hand while performing repetitive tasks such as operating the keyboard of a computer. The apparatus can be adapted to a variety of mounting devices depending on the particular work-place environment, but preferably it is adapted to an articulating arm assembly which permits the user to freely adjust the apparatus for position, height, and horizontal and vertical tilt. The forearm rest portion of the apparatus supports the user's arm in a feeder tray, while the hand rest portion supports the palm and wrist of the hand with a cylindrical rest which rotates about an axis between extending through the ends of the cylindrical rest, the axis being offset in relation to the axis extending through the center of the cylindrical rest. Alternatively, the hand rest portion supports the palm and wrist of the hand with an inverted spoon-shaped member having a convex platform which fits the natural curvature of the palm of an individual's hand and an elongated arm which supports the wrist.

17 Claims, 7 Drawing Sheets

FIG.—5
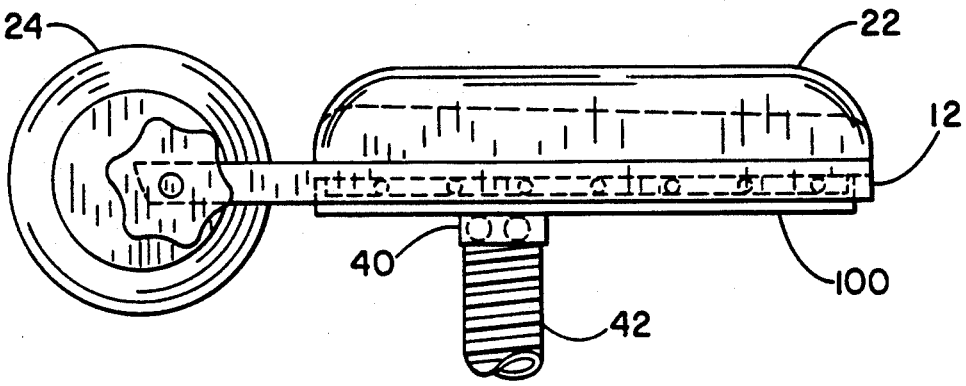
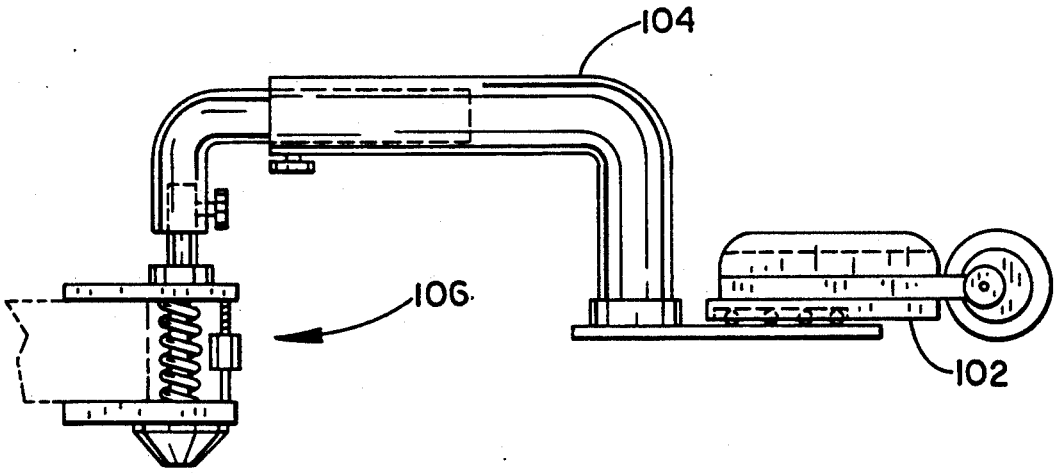
FIG.—6

ARTICULATING ERGONOMIC SUPPORT SYSTEM

This is a continuation-in-part of copending application(s) Ser. No. 07/602,713 filed on Oct. 23, 1990 now abandoned.

BACKGROUND OF THE INVENTION

1. Field of the Invention

This invention pertains to an articulating ergonomic support system for an individual's forearm, wrist and palm of the hand.

Cumulative trauma disorders of the arm, wrist, hand, shoulders, and neck are being diagnosed as being caused by repetitive motions while performing tasks in the work-place. Data entry operators and other users of computers, computer terminals and the like, can experience such disorders caused by repeated use of computer keyboards. This results from repeated or forceful exertions, particularly in combination with improper wrist postures or awkward forearm angles, because proper support for the shoulder, neck, forearm, wrist and palm of the hand are lacking.

Typical cumulative ailments include tendinitis, synovitis, bursitis, tenosynovitis, stenosing-tenosynovitis, arthritis, and Carpal Tunnel Syndrome. These disorders can also result from other repetitive tasks such as the diversified operations of production assembly lines. Carpal Tunnel Syndrome, one of the more serious of these disorders, c:an cost as much as $70,000 to treat in areas of the western Unit.ed States. The resultant disability and therapy can cause up to six months or more of lost work time.

The carpal tunnel is an anatomical structure formed by the eight carpal bones of the wrist on three sides and by ligaments on the fourth palmar side. The median nerve, tendons, and blood vessels are conveyed through the tunnel. This tunnel is 2 to 3 centimeters long for males and shorter for females. Cumulative trauma ailments are 3 to 5 times more prevalent in women than in males.

Carpal Tunnel Syndrome is caused by repetitive, extensionflexing, ulnar deviation, wrist constriction, and so forth, that compresses the median nerve. Ultimately, surgery may be required to reduce the compression of the median nerve. This procedure requires making an incision in the palm of the hand and partially releasing the transverse carpal ligament to reduce the compression within the carpal tunnel on the median nerve.

When a person is seated at a desk or other work surface, the upper arm is aligned nearly perpendicular to the floor and the forearm forms a near right angle at the elbow. Therefore, when tasks are performed, the forearm actually moves and raises through an arc. In order to reduce cumulative trauma disorders resulting from these movements, a device is required which will properly support the wrist and for.earm, yet provide the ability to freely move the arms about the work surface.

2. Description of the Backqround Art

Several examples of other types of support devices can be found. A common device is a "feeder pan" which is a term for an arm support used in occupational therapy. For example, U.S. Pat. No. 4,069,995, issued to Miller on Jan. 24, 1978, describes an apparatus for supporting an individual's arm in a feeder pan or tray to enable the user to perform manipulative acts with his hands and fingers without relying upon arm or shoulder muscles. Although feeder pans do provide a degree of support for the arm, they do not address the requirement or support of the wrist and palm of the hand.

U.S. Pat. No. 4,709,972, issued to LaBudde et al. on Dec. 1, 1987, shows a sliding computer keyboard tray with a removable door which can be used to support the heels of the hands or wrists of the operator. Although providing for some degree of wrist support, the device shown in that patent does not address the need for support of the forearm or palm of the hand.

An undated printed publication by sit-rite international inc. / sit-rite products ltd. shows a device called an "ErgoArm" which is of the feeder pan type. That publication shows the device supporting only the forearm of the user, but does not address the requirement of supporting the wrist or palm of the hand.

An articulating support for equipment in general can be seen in U.S. Pat. No. 4,546,708, issued to Wilburth on Oct. 15, 1985. That patent shows a support platform for a computer terminal and keyboard. U.S. Pat. No. 4,688,862, issued to Fowler et al. on Aug. 25, 1987, describes a work-station for use with electronic instrumentation which permits the equipment to be supported in various positions to minimize muscle fatigue and strain during operation. Neither of these patents, however, disclose supports for the forearm, hand, wrist or palm of the hand of the user.

U.S. Pat. No. 4,650,249, issued to Serber on Mar. 17, 1987, discloses an ergonomic support system for a person in a seated position, which support system includes a forearm rest and tray, but does not address support for the wrist or palm of the hand.

The foregoing patents reflect the state of the art of which the applicant is aware and are tendered with the view toward discharging applicant's acknowledged duty of candor in disclosing information which may be pertinent in the examination of this application. Accordingly it can be seen that cumulative trauma disorders of the forearm, wrist and hand have not been addressed by an apparatus which provides proper support for the forearm, wrist and palm of the hand. It is respectfully stipulated, therefore, that none of these patents teach or render obvious, singly or when considered in combination, applicant's claimed invention.

SUMMARY OF THE INvENTION

This invention pertains to an articulating ergonomic support system for an individual's forearm, wrist and palm of the hand and, more particularly, an ergonomic support device which can be readily adapted to any work environment, including those requiring articulating support mechanisms.

By way of example and not of limitation, the invention generally comprises a cylindrically shaped or arced shaped hand rest support which revolves about an axis which is offset from its center, a saddle assembly for supporting the forearm of the user, a support plate to which the palm rest support and saddle assembly are attached, and an articulated mounting assembly which is adaptable to various mounts suitable for the particular application in which the device will be used. The user mounts or positions the device in a convenient location, places the forearm in the saddle, rests the palm of the hand on the hand rest support, and revolves the hand rest support about its axis to the desired support position. An alternative embodiment uses a spoon-shaped hand support instead of a cylindrical or arced shaped support. In this embodiment, the user rests the palm of the hand on the convex portion of the hand support, the size and shape of the hand support conforming to the natural concave curvature of the palm of the hand of the user. The device can be attached to a desk, a computer keyboard tray, arms of a chair, a pedestal base, and other support mechanisms.

An object of the invention is to support the forearm, wrist, and palm of a user of hand operated equipment.

Another object of the invention is to provide such a support which allows the user to freely move the support into a position of maximum comfort and convenience.

Still another object of the invention is to provide such a support which is readily adaptable to a variety of attachment mechanisms.

Another object of the invention is to reduce cumulative trauma disorders in the work-place resulting from repetitive movement of the unsupported arm, wrist, and hand.

Another object of the invention is to reduce the tendency toward carpal tunnel syndrome associated with prolonged or repetitive use of computer keyboards.

Another object of the invention is to reduce neck and shoulder stress and muscular tension resulting from repetitive motion.

Still another object of the invention is to reduce compression of the median nerve in the hand resulting from improper support while performing repetitive tasks.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only:

FIG. 5 shows an embodiment of the apparatus shown in FIG. 1 adapted to a sliding base mount.

FIG. 6 shows an embodiment of the apparatus shown in FIG. 5 adapted to a tubular mounting arm.

DESCRIPTION OF THE PREFERRED EMBODIMENT

Figure 1:
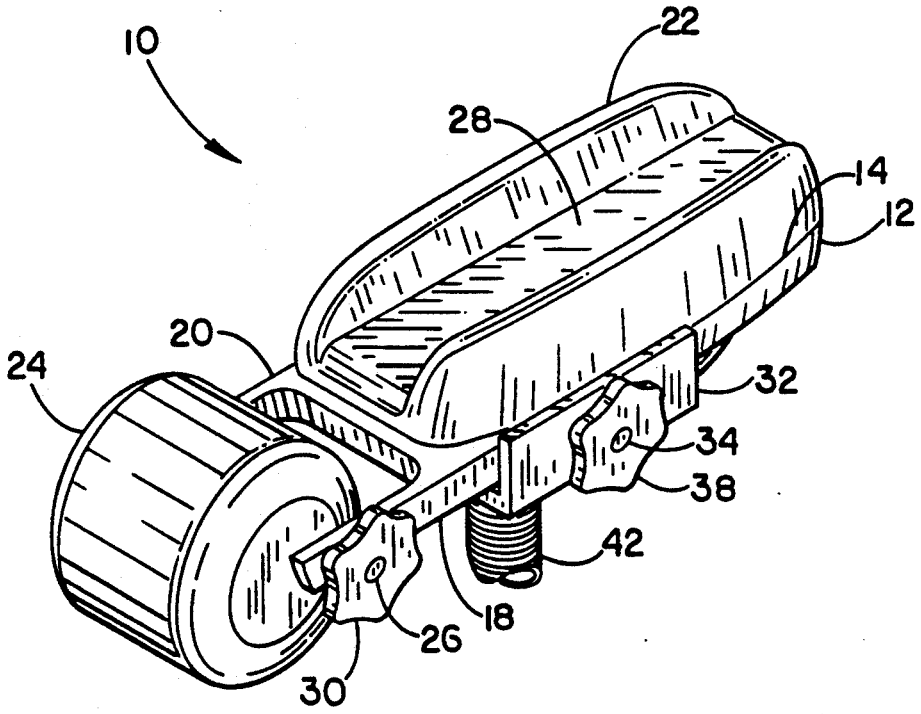
FIG. 1 is a perspective view of one embodiment of the invention.
Figure 2:
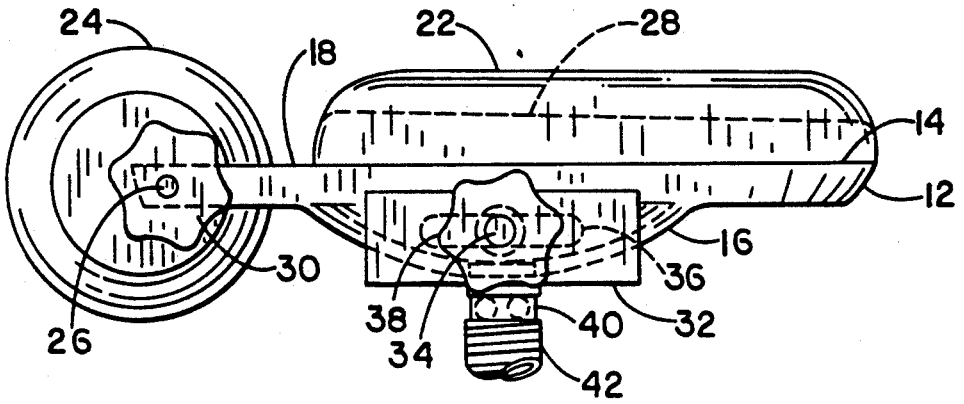
FIG. 2 is a side elevation view of the apparatus depicted in FIG. 1 showing the apparatus adapted for universal mounting.
Figure 3:
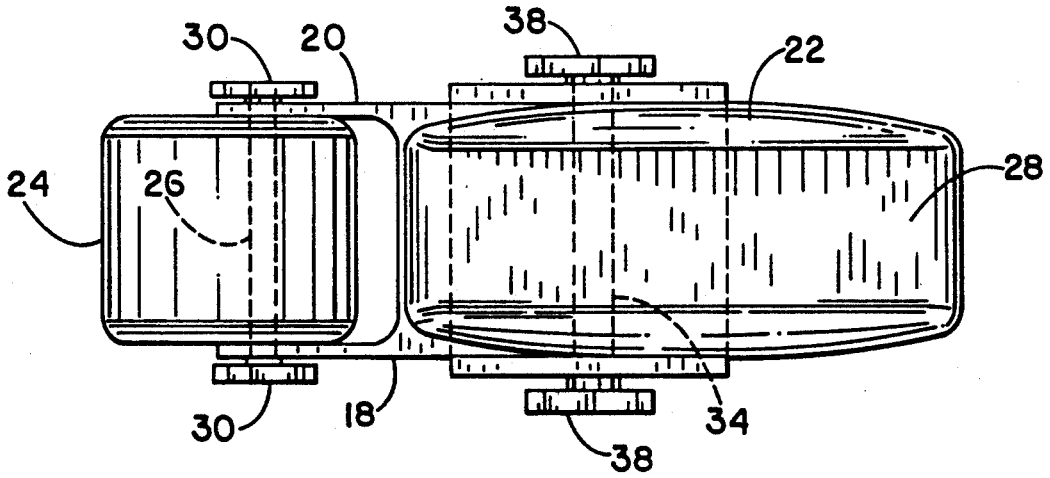
FIG. 3 is a top elevation view of the apparatus shown in FIG. 1.

Referring more specifically to the drawings, for illustrative purposes the present invention is embodied in the apparatus generally shown in FIG. 1 through FIG. 3. It will be appreciated that the apparatus may vary as to configuration and as to details of the parts without departing from the basic concepts as disclosed herein.

Support assembly 10 serves as a universal embodiment of the apparatus, adaptable to a variety of mounting applications. Several examples of those mounting applications are disclosed herein.

Base 12 serves as a coupling means between hand support 24 and saddle 20. In the preferred embodiment, base 12 is formed such that it has a flat top portion 14, a curved bottom portion 16, and fork members 18 and 20 extending from one end as shown. Saddle 22 is attached to the flat top portion 14 of base 12. Hand support 24 is positioned between fork members 18 and 20 and attached by means of a bolt 26 extending through fork member 18, hand support 24, and fork member 20. This assembly defines the basic structure to support an individual's forearm, wrist and palm. Base 12 can be formed from materials such as metal, wood, plastic and the like.

Saddle 22, made from wood, metal, plastic and the like is typically formed with a flat bottom portion for attachment to the top portion 14 of base 12, and a concave top portion 28 for placement of an individual's limb therein. In the concave top portion 28 of saddle 22, a cushion made from materials such as polyurethane, rubber or other synthetic foam material and the like is applied for the user's comfort. Therefore, rigid materials should only be used as a core and covered with the cushion material. An outer covering of cloth, vinyl or other material should also be used to resist perspiration and bacterial growth. Suitable outer coverings can be made from vinyls, woven cloth, clean room vinyl, electrostatic dissipation material, and the like, or combinations of the foregoings, depending upon the particular application.

The concave top portion 28 of saddle 22 is formed in such a way that it cradles the user's limb and prevents the user's limb from sliding off which could result if that portion of saddle 22 was flat. Rather than a pre-formed concave top portion 28 being employed, however, saddle 22 can be made of or contain a material which is deformable, such that the weight of the individual's limb placed thereon will cause saddle 22 to deform around the point of its contact with the individual's limb and essentially mold to the shape of the limb. A typical deformable material to use would be a silicone gel material contained in a bag made from urethane or other flexible material. The degree of deformability can thus be controlled by the varying the stiffness of the urethane bag or the density of the silicone gel material. Another approach would be to use compressed air in a bag or bladder, in which the pressure of the compressed air would be adjusted to the desired degree of firmness.

In the embodiment shown, hand support 24 is a cylindrical shaped member made of metal, wood, plastic and the like, typically upholstered with cloth or other material for the user's comfort. The preferred approach is to use a nylon rod as the core, cover the nylon rod with a foam outer layer, and then cover the foam outer layer with a cloth material. This will provide a soft cushion for support of the palm and wrist of the individual.

Proper use of materials is extremely important because all vascular and nervous systems between the hand and the forearm pass close to the surface in the wrist area. Additionally, the materials selected must be resistant to perspiration and bacterial growth from perspiration.

To meet sterility requirements in certain applications, either saddle 22 or hand support 24 could be made from materials such as stainless steel, fiberglass, flexible skinned polyurethane, and the like.

Bolt 26 extends through a hole in hand support 24 which extends through hand support 24 longitudinally from one end to the other. The hole in hand support 24 is larger than bolt 26 so that hand support 24 will rotate between fork member 18 and fork member 20.

Hand support 24 rotates about an axis defined by the hole and bolt extending longitudinally between its two ends. In one embodiment, the hole through hand support 24 extends from through the center of hand support 24 and parallel to its surface. In the preferred embodiment, however, the hole is offset from the center of hand support 24. This offset is a significant feature and is crucial for proper support.

In its intended manner of use, the user would place his or her forearm in saddle 22 and place the palm or wrist of his or her hand upon hand support 24. By offsetting the hole through hand support 24 from its longitudinal center, the user is able to adjust both the height and distance between the support derived from saddle 22 and the support derived from hand support 24. By rotating hand support 24, the user then can achieve a continuous range of adjustment for proper support. Additional ranges of adjustment can be achieved by varying the diameter of hand support 24, although a diameter of approximately one and one-half inches is suitable for most applications, or by adjusting the position of the offset of the hole through hand support 24.

If the hole remains parallel to the surface of hand support 24, then rotation of hand support 24 will result in the offset characteristic being uniformly distributed from one end of hand support 24 to the other. This has the advantage that the apparatus can be used for either the right hand or the left hand. However, during pronation of the forearm and wrist, the wrist is slightly rotated toward one end of hand support 24. For example, the wrist on the right hand which is in full pronation is rotated slightly to the right, whereas the wrist on the left hand which is in full pronation is rotated slightly to the left. Therefore, for the best level of support, hand support 24 should be rotated slightly to follow the rotation of the wrist. This is accomplished by rotating the entire apparatus, by offsetting fork member 18 and fork member 20, by making the holes in fork member 18 and fork member 20 vertically oblong so that the ends of bolt 26 can be adjusted to different heights, or by further offsetting the hole in hand support 24 so that the axis of rotation is not parallel to the surface of hand support 24.

As an additional ergonomic support feature, the concave top portion 28 of saddle 22 is preferably formed with a slope rather than being parallel to base 12 to control the vertical resting angle of an individual's limb placed therein. This feature reflects the fact that during pronation of the forearm it is difficult for the user to lay his or her wrist down flat. Therefore, by making the end of saddle 22 closest to hand support 24 higher than the other end, the user will be able to achieve proper support during pronation of the forearm and wrist. Furthermore, as is done with hand support 24, saddle 22 is preferably rotated slightly to more closely match the position of the forearm with respect to the position during pronation of the forearm and wrist.

It can thus be seen that the apparatus maintains planar alignment of the wrist and forearm during pronation of the palm, while permitting the individual to freely utilize the fingers of the hand. This support reduces compression of the nerves, tendons, synovial sheaths and vascular system passing between the wrist and the forearm. While it is important to maintain planar alignment of the wrist and forearm (neutral plane), a slight vertical extension of the palm, knuckles and fingers of the hand from the neutral plane is desirable in order to place the fingers in a natural and comfortable position to operate a computer keyboard, typewriter or the like.

Once the desired rotational position of hand support 24 is achieved, knobs 30 on each end of rod 26 are rotated to tighten fork members 18 and 20 against each end of hand support 24, fork members 18 and 20 having sufficient flexibility to be compressed against hand support 24 when knobs 30 are tightened. Rod 26 has threaded ends and knobs 30 having corresponding threads.

Additional articulation and adjustment in relation to the working position of the user is achieved by means of bracket 32 which is a "U-shaped" bracket having two side walls with holes 36 through which bolt 34 is extended. Bolt 34 also extends through curved bottom portion 16 of base 12. This permits the user to swivel or tilt base 12 in a vertical direction about the horizontal axis defined by bolt 34. Curved bottom portion 16 of base 12 rests on bracket 32 for support and provides a smooth rocking motion. Opening 36 in curved bottom portion 16 of base 12 is an oblong hole running lengthwise to base 12 to provide a sliding motion.

The curvature in the bottom of base 12 results in a smoother adjustment than if the bottom of base 12 were flat or some other shape. In preferred embodiment, the curved bottom portion 16 of base 12 is not solid, but consists of curved "fins" on each side of base 12 with a void in between the fins, and an oblong opening 10 36 in each fin. Opening 36 is oblong in shape as shown to provide a means for the user to slide base 12 from front to rear of bracket 32. This gives the user an additional means for positional control over saddle 22 and hand support 24.

Bolt 34 is threaded on each end to accept knobs 38 on each side of bracket 32, which knobs have matching threads. Once the user has selected a satisfactory vertical tilt and sliding position for base 12, knobs 38 can be tightened to prevent further movement of base 12 in bracket 32, the sides of bracket 32 being sufficiently flexible to be compressed against base 12 when knobs 38 are tightened. Alternatively, knobs 38 can remain loose to permit base 12 to freely rock in bracket 32.

For smoother operation, both bolt 26 and bolt 34 can be enclosed by a tubular bearing through hand support 24 and base 12, respectively.

For attachment to an external support such as a stand, table, chair and the like, bearing 40 with threads 42 is attached to bracket 32. Bearing 40 provides additional swiveling motion on a horizontal plane so that the user can position the apparatus into place more easily. Threads 42 can be attached directly to a clamp assembly, attached directly to a swivel mount for further articulation, attached to a connecting arm assembly with swivel joints for further articulation, or the like for ultimate attachment to the external support as further described herein.

Thus far has been described the apparatus which can be attached to a variety of supporting structures depending upon the particular work-place environment and application.

Figure 4:
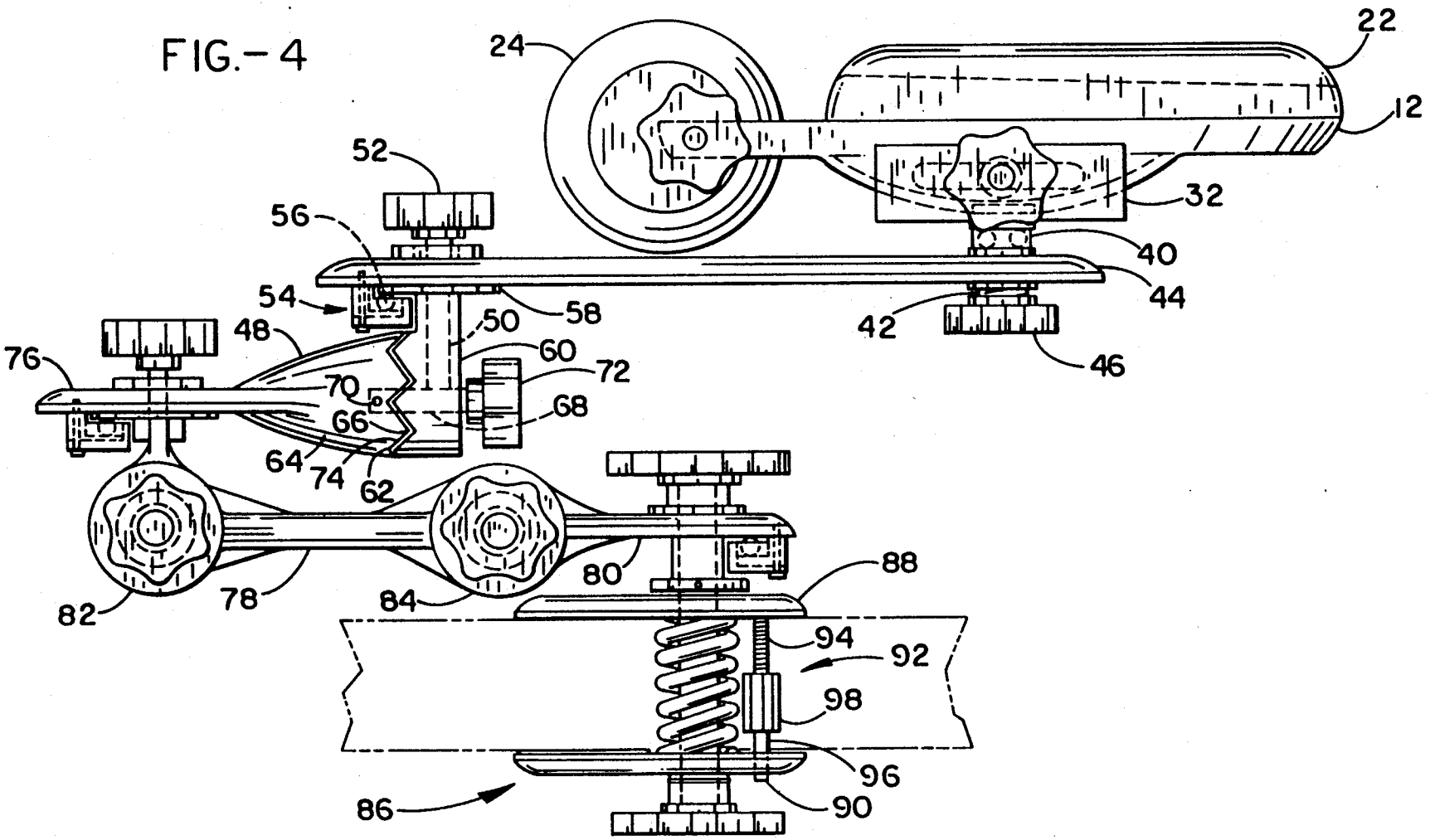
FIG. 4 is a side elevation view of the apparatus shown in FIG. 1 adapted to an articulating arm.

FIG. 4 shows the apparatus as part of a fully adjustable articulating arm assembly. Connecting arm 44 is attached to support the apparatus by means of threads 42 extending through a hole in one end of connecting arm 44 and being secured by knob 46. This results in connecting arm 44 being pivotally mounted to bracket 32, rotatable about bearing 40.

At the other end of connecting arm 44 is located a universal swivel mount 48 which permits horizontal and vertical swivel adjustments. Swivel mount 48 has a vertical upright post 50 with threads which extends through connecting arm 44 and which is secured by knob 52. Swivel mount 48 is pivotally coupled to connecting arm 44 by using a tubular bearing over the threads or, in the preferred embodiment, external bearing assembly 54. External bearing assembly 54 is an "L-shaped" bracket with one leg rigidly attached to the underside of connecting arm 44. The other leg contains bearing 56 which is up against plate washer 58, plate washer 58 being captured within the mechanism between vertical upright post 50 and the underside of connecting arm 44. Plate washer 58 is installed in a manner such that it does not rotate but is fixed in position with respect to upright post 50, such that bearing assembly 54 rotates around on the underside of plate washer 58. Thus, connecting arm 44 and bearing assembly 54 pivot around the plate washer 58 and upright post 50.

Vertical upright post 50 is attached to a circular shaped flange 60 with serrated teeth 62 around its perimeter. Mating with flange 60 at a right angle is joint body 64 having an end with a circular surface and serrated teeth 66 around its perimeter. Flange 60 and joint body 64 are attached with rod 68 which extends through a hole in the center of flange 60 and into the center of joint body 64. The end of rod 68 which extends into joint body 64 is secured in place with pin 70 which extends through the side of joint body 64 and into rod 68. The other end of rod 68 is threaded to accept knob 72 which secures flange 60 and joint body 64 together. Additionally, oil impregnated nylon washer 74 is located between the mating surfaces between flange 60 and joint body 64 to permit smooth rotation.

Thus is can be seen that the mating surfaces between flange 60 and joint body 64 can be rotated and locked into position by means of serrated teeth 62 and 66.

The other end of joint body 64 tapers to a point at which one end of connecting arm 76 is rigidly attached. The other end of connecting arm 76 contains a hole through which a mounting mechanism can be attached.

At this point it should be understood that complete articulating movement can be derived from the apparatus and support mechanism described. For example, assuming that both connecting arm 44 and connecting arm 76 are fixed in position and parallel to a reference surface, base 12 can be horizontally rotated in a three-hundred and sixty degree pattern. Base 12 can also be tilted vertically in a direction perpendicular to the reference surface. Furthermore, base 12 can be slid to and fro.

Now, by adjusting swivel mount 48, a lateral tilt angle can be added. Thus an entirely new plane through which base 12 can be rotated is achieved. These adjustments provide for an infinite number of variations in the position of limb support. Additionally, by rotating connecting arm about its connection point to swivel mount 48, the position of base 12 can be further changed. Similar repositioning will occur by rotation of connection arm 76 about its connection to the external mounting mechanism. If desired, additional connecting arms such as connecting arms 78 and 80, and swivel mounts such as swivel mounts 82 and 84 could be added for further articulation and height adjustment.

Therefore, the apparatus described herein is adaptable for use in any work place environment.

By attaching clamp mechanism 86 to threads 42 directly, to connecting arm 44, to connecting arm 76, to connecting arm 78, or to conneoting arm 80, the apparatus can be mounted to a table, desk-top, or other object. As shown in FIG. 4, clamp mechanism 86 has adjustable jaws 88 and 90 which are tightened to meet the edges of the mounting surface. To prevent jaws 88 and 90 from slipping off of the mounting surface, standoff mechanism 92 is installed between jaws 88 and 90. Jaws 88 and 90 are adjusted into place around the mounting surface and then standoff mechanism 92 is adjusted to keep jaws 88 and 90 parallel. Standoff mechanism 92 is made of rod 94, rod 96, and nut 98. One end of rod 94 is rigidly attached to jaw 88. The other end of rod 94 is threaded and is threaded into nut 98. One end of rod 96 is rigidly attached to nut 98. The other end of rod 96 rotates through a hole in jaw 90. Nut 98 is adjusted until its lower end is tight against jaw 90. Once standoff mechanism 92 is adjusted so that jaws 88 and 90 are parallel, clamping mechanism 86 can be completely tightened into place.

To assist in the return to various positions pre-set by the user, graduated bubble levels could be affixed to the various connecting arms and tilt and swivel mechanisms. It should also be noted that, when used in the multi-arm configuration shown in FIG. 4, clamping mechanism 86 as shown permits the several connecting arms to be positioned above the mounting surface. Clamping mechanism 86 could also be attached in such a way as to permit the connecting arms to be positioned below the mounting surface. This is easily accomplished by flipping the assembly such that jaw 90 is on top of the work surface and jaw 88 is on the bottom of the work surface, and then rotating the position of upright post 50 in swivel mount 48 by approximately one-hundred and eight degrees to reposition base 12, saddle 22 and hand support 24 in an upright position.

Figure 7:
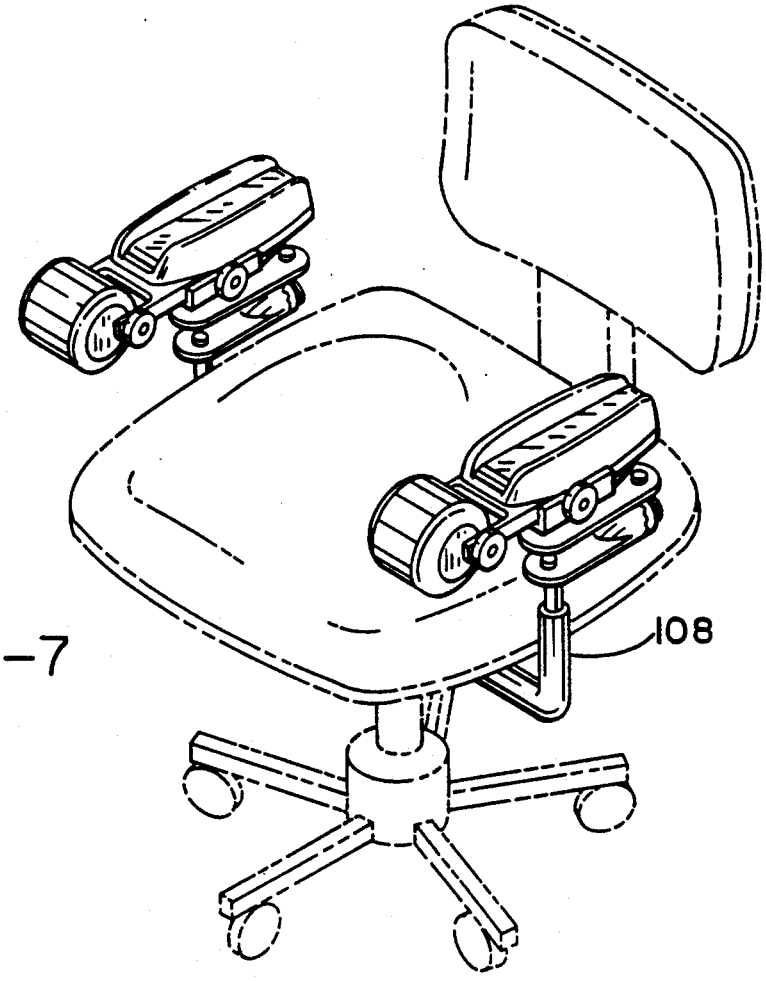
FIG. 7 shows an embodiment of the apparatus shown in FIG. 1 adapted as arms of a chair.
Figure 8:
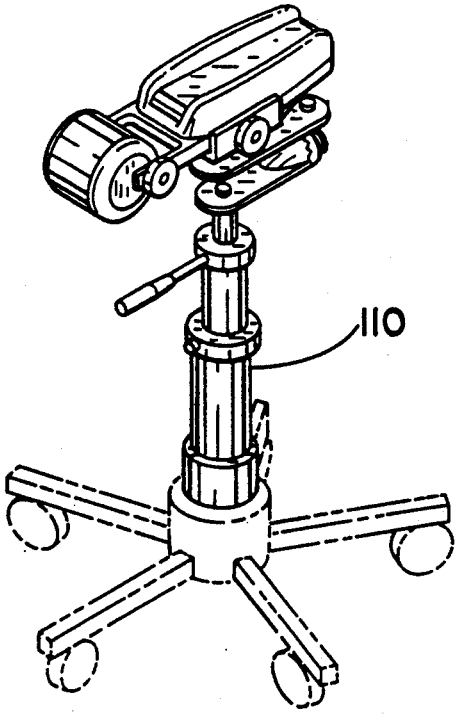
FIG. 8 shows an embodiment of the apparatus shown in FIG. 1 adapted to a rolling free-standing base.
Figure 9:
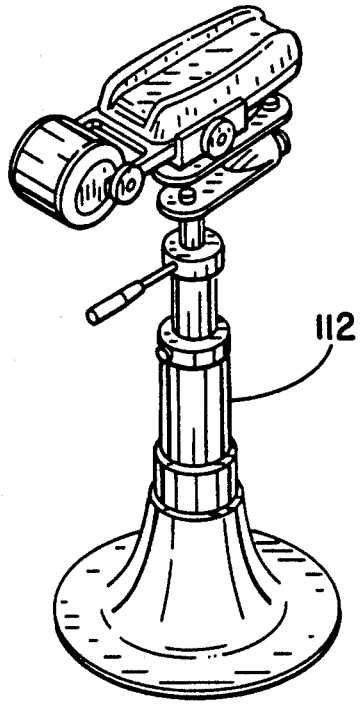
FIG. 9 shows an embodiment of the apparatus shown in FIG. 1 adapted to a free-standing pedestal base.
Figure 10:
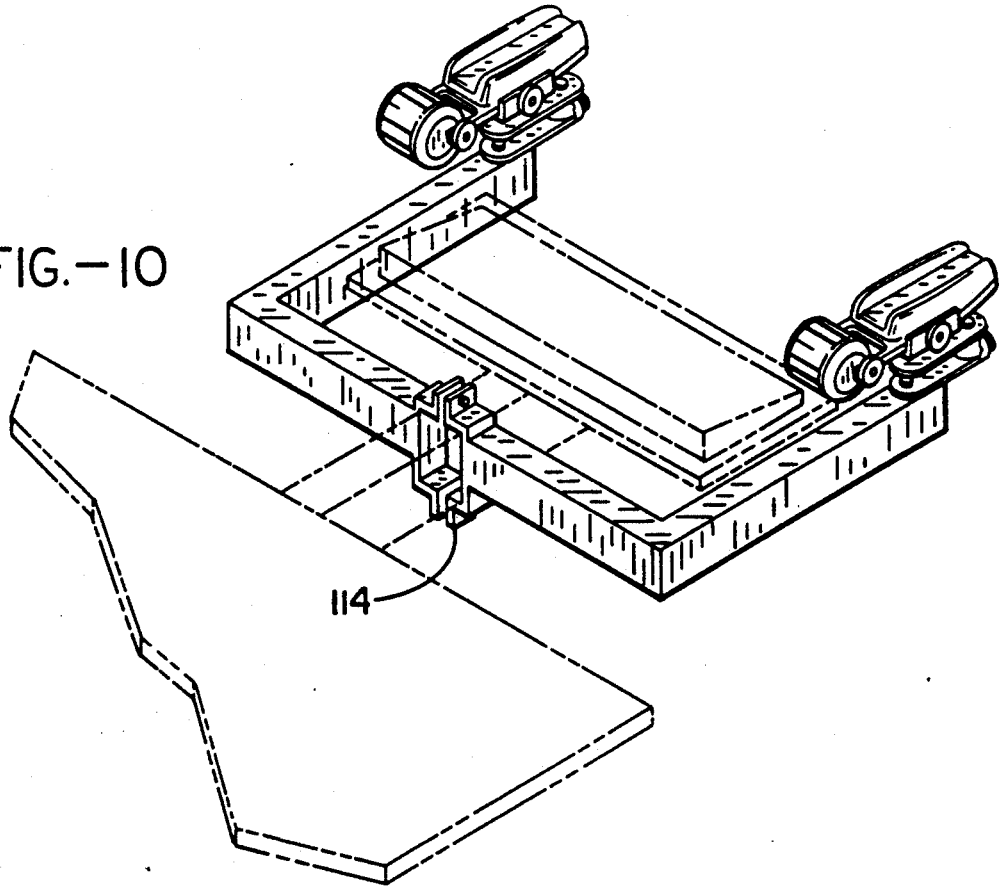
FIG. 10 shows an embodiment of the apparatus shown in FIG. 1 adapted to a computer keyboard tray support bracket.

Referring now to FIG. 5 through 10, various alternative mounting embodiments are shown. In FIG. 5, base 12 is connected to a bearing plate 100 which permits only sliding movement. Bearing plate 100 contains roller l,earings or ball bearings retained between the bottom surface of base 12 and the top surface of bearing plate 100. In FIG. 6, the apparatus is attached to a bearing plate 102 similar to bearing plate 100 thus permitting only sliding movement, and bearing plate 102 is in turn attached to tubular arm 104, which is in turn attached to clamping mechanism 106 similar to clamping mechanism 86. In FIG. 7, it can be seen that the apparatus as described can be attached to a chair. This can be accomplished by attachment to the arms of the chair using clamping mechanism 86 or, in the case of an armless chair, by attaching "U-shaped" support bracket 108 to the chair as shown. In FIG. 8, the apparatus is adapted to a tubular pipe stand 110 which is in turn attached to a moveable base. In FIG. 9, the apparatus is attached to a freestanding pedestal base 112. FIG. 10 shows one embodiment of how the apparatus would be adapted to the neck of a computer keyboard tray support by use of coupling bracket 114.

Figure 11:
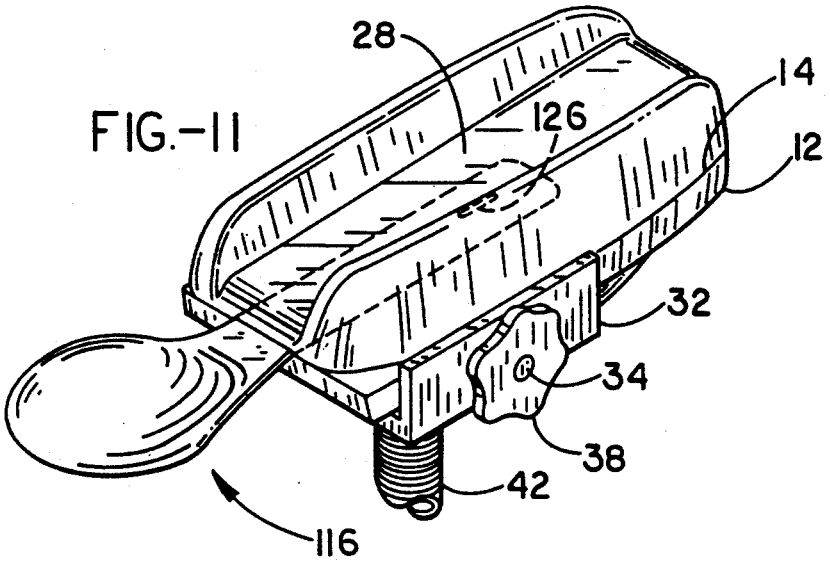
FIG. 11 shows a perspective view of an alternate embodiment of the invention having an inverted spoon-shaped hand rest.
Figure 12:
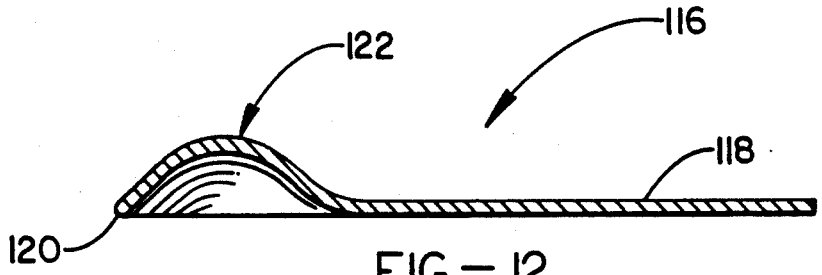
FIG. 12 shows a cross-sectional view of the hand rest of FIG. 11.
Figure 13:
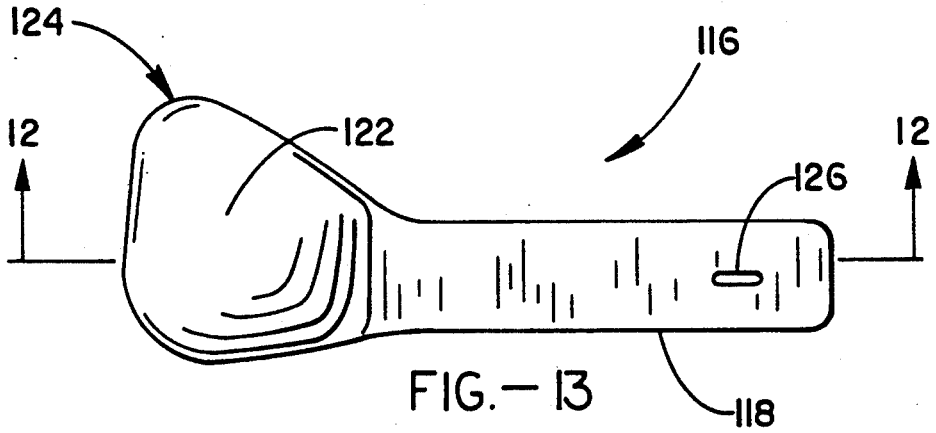
FIG. 13 shows a top plan view of the hand rest of FIG. 11.

Referring now to FIG. 11 through FIG. 13, an alternate embodiment of the invention uses, instead of a cylindrical or arced hand support as heretofore described, an inverted spoon-shaped member 116 to support the hand and wrist of the user. Spoon-shaped member 116 generally comprises an elongated "tongue-like" arm 118 and a cupped platform 120 extending from one end of arm 118. Platform 120 is vertically displaced from arm 118 as shown and has a convex top surface 122 to fit the natural curvature of the user's palm which will rest on platform 120. Ideally, convex top surface 122 is located near the central portion of platform 120 as shown. Platform 120 can be circular, elliptical or any other convenient shape so long as it conforms to the palm of the user's hand. In the preferred embodiment, platform 120 has rounded edges so that the user's palm is not irritated as would occur if the edges were pointed.

Materials from which spoon-shaped member 116 can be made include wood, metal, plastic and the like. For additional comfort, spoon-shaped member 116 can be covered with an upholstery material over a cushion material, or covered with a urethane skin foam covering. For ease of construction of the present invention, spoon-shaped member 116 can be adapted from a "wrist-splint preformed aluminum stay" utilized in the medical profession for supporting a broken wrist in a cast or a wrist splint.

Because the palm of the hand forms a natural concave shape which is not round but is slightly irregular, the preferred embodiment includes tab 124 extending from one edge of platform 120. FIG. 13 shows the location of tab 124 for use with the left hand. Thus, tab 124 would extend toward the heel of the left hand. For use with the right hand, tab 124 would be located at the opposite side of platform 120 and extend toward the heel of the right hand.

Preferably, spoon-shaped member 116 is pivotally attached to base 12 by means of slot 126. This permits the user to adjust the position of spoon-shaped member 116 through an arc in a direction lateral to the base 12. Additionally, by making slot 126 elongated lengthwise along arm 118 as shown, the user is able to adjust the distance between platform 120 and base 12. Placement of slot 126 is not critical so long as the desired range of motion is achieved.

In use, the user places the palm of his or her hand over the platform 120 and adjusts the position of spoons-shaped member 116 in relation to base 12. Because of the shape of spoon-shaped member 116, not only does arm 118 serve to couple spoon-shaped member 116 to base 12, but arm 118 supports the user's wrist.

Accordingly, it will be seen that this apparatus can be used to support an individual's arm or forearm, and wrist or palm of the hand, while performing repetitive tasks requiring hand and finger movement, thus reducing the likelihood of carpal tunnel syndrome and other cumulative trauma disorders. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An ergonomic support apparatus for prevention of cumulative trauma disorders of the forearm, wrist and hand, comprising:

(a) first support means for supporting the wrist of an individual's hand;

(b) second support means for supporting the palm of said individual's hand while freeing the fingers of said individual's hand for performing manipulative taks, said second support means joined to said first support means, said second support means having a vertically inclined surface relative to the surface of said first support means; and (c) third support means for supporting said individual's forearm, said third support means coupled to said first support means, said third support means being in general planar alignment with said first support means, whereby said first support means and said third support means maintain planar alignment of said wrist and said forearm during pronation of said palm, thereby reducing compression of the tendons, synovial sheaths and vascular system passing through the wrist area between said forearm and said hand.

2. The apparatus as recited in claim 1, wherein said third support means comprises a saddle, said saddle including a concave portion for placement of said forearm therein.

3. The apparatus as recited in claim 2, further comprising deforming means for deforming said concave portion of said saddle, said deforming means being responsive to the placement of said forearm upon said saddle, whereby said saddle cradles said forearm.

4. The apparatus as recited in claim 1, further comprising:

(a) tilting means for vertical tilting motion of said first, second, and third support means;

(b) swivel means for horizontal swiveling motion of said first, second, and third support means, said swivel means attached to said tilting means; and (c) rocking means for rocking motion of said first, second, and third support means, said rocking means attached to said third support means, said rocking means including a convex arcuate surface, said rocking means pivotally coupled to said tilting means.

5. The apparatus as recited in claim 4, further comprising sliding means for sliding motion of said first, second, and third support means, said rocking means including said sliding means.

6. The apparatus as recited in claim 5, further comprising:

(a) fourth support means for supporting said swivel means; and (b) attachment means for attaching said swivel means to said fourth support means.

7. The apparatus as recited in claim 6, wherein said fourth support means comprises:

(a) a first connecting arm, one end of said first connecting arm being attached to said attachment means; and (b) mounting means for mounting said first connecting arm to an external support device for horizontal swiveling movement and for vertical swiveling movement, said mounting means being attached to the other end of said first connecting arm.

8. The apparatus as recited in claim 1, wherein said first and second support means form an inverted spoon-shaped member including an arm and a platform, said platform extending from one end of said arm, said platform being convex near its central portion, said arm pivotally coupled to said third support means, said arm pivoting laterally in relation to said third support means, said arm providing support for said wrist, said platform providing support for said palm.

9. The apparatus as recited in claim 8, including a tab, said tab positioned near the edge of said platform, said tab providing support for the heel area of said palm.

10. The apparatus as recited in claim 9, wherein said first support means is slidably coupled to said third support means.

11. The apparatus as recited in claim 1, wherein said first support means comprises an elongated arm, said arm having a first end and a second end, said arm pivotally coupled to said third support means, said arm pivoting laterally in relation to said third support means, said arm providing support for said wrist.

12. The apparatus recited in claim 11, wherein said second support means comprises:

(a) a platform, said platform extending from one end of said arm, said platform being centrally convex in relation to an axis substantially perpendicular to the longitudinal axis between said first and second end of said arm, said arm and said platform generally defining an ivnerted spoon-shaped member, said platform providing support for said palm; and (b) a tab, said tab extending from one edge of said platform, said tab providing support for the heel area of said palm.

13. The apparatus as recited in claim 12, wherein said first support means is slidably coupled to said third support means.

14. An apparatus for supporting the forearm, wrist and palm of an individual, comprising:

(a) a base;

(b) an inverted spoon-shaped member, said spoon-shaped member including an elongated tongue and a platform, said platform extending from one end of said tongue, said platform having a vertically inclined surface relative to the surface of said tongue, said platform being convex near its central portion, the other end of said tongue pivotally coupled to said base, said tongue pivoting laterally in relation to said base, whereby said platform supports said individual's palm while freeing the fingers for performing manipulative tasks and said tongue supports said individual's wrist;

(c) support means for supporting an individual's forearm, said support means connected to said base, said support means and said tongue being in eneral planar alignment, whereby said spoon-shaped member and said support means maintain planar alignment of said wrist and said forearm during pronation of said palm, thereby reducing compression of the tendons, synovial sheaths and vascular system passing through the wrist area between said forearm and said hand;

(d) tilting means for vertical tilting motion of said spoon-shaped member and said support means;

(e) swivel means for horizontal swiveling motion of said spoon-shaped member and said support means, said swivel means attached to said tilting means; and (f) sliding means for sliding motion of said spoon-shaped member and said support means; and (g) rocking means for rocking motion of said spoon-shaped member and said support means, said rocking means attached to said base, said rocking means including a convex arcuate surface, said rocking means pivotally coupled to said tilting means, said rocking means including said sliding means.

15. The apparatus as recited in claim 14, further comprising:

(a) second support means for supporting said base; and (b) attachment means for attaching said base to said second support means.

16. An articulating ergonomic forearm, wrist and palm support apparatus, comprising:

(a) a base;

(b) an inverted spoon-shaped member attached to said base, said spoon-shaped member including an elongated arm and a platform, sid platform extending from one end of said arm, said platform having a vertically inclined surface relative to the surface of said tongue, said platform being convex near its central portion, the other end of said arm pivotally coupled to said base, said arm pivoting laterally in relation to said base, said arm providing support for said individuals wrist, said platform providing support for said individual's palm while freeing the fingers for performing manipulative tasks;

(c) a saddle, said saddle including a concave portion for placement of said individual's forearm therein, said saddle attached to said base, said saddle and said tongue being in general planar alignment, whereby said spoon-shaped member and said saddle maintain planar alignment of said wrist and said forearm during pronation of said palm, thereby reducing compression of the tendons, synovial sheaths and vascular system passing through the wrist area between said forearm and said hand;

(d) tilting means for vertical tilting motion of said spoon-shaped member and said support means;

(e) swivel means for horizontal swiveling motion of said spoon-shaped member and said support means, said swivel means attached to said tilting means; and (f) sliding means for sliding motion; and (g) rocking means for rocking motion of said spoon-shaped member and said support means, said rocking means attached to said base, said rocking means including a convex arcuate surface, said rocking means pivotally coupled to said tilting means, said rocking means including said sliding means.

17. The apparatus as recited in claim 16, further comprising deforming means for deforming said saddle, said deforming means being responsive to the placement of an individual's forearm upon said saddle, whereby said saddle molds to the shape of said forearm.

* * * * *

UNITED STATES PATENT AND TRADEMARK OFFICE

CERTIFICATE OF CORRECTION

PATENT NO. : 5,135,190

DATED : August 4, 1992

INVENTOR(S) : Robert W. Wilson

It is certified that error appears in the above-indentified patent and that said Letters Patent is hereby corrected as shown below:

Column 1, line 44, change "extensionflexing" to --extension-flexing--.

Column 1, line 59, change "for.earm" to --forearm--.

Column 2, line 47, change "INvENTION" to --INVENTION--.

Column 6, line 42, change "10 36" to --36--.

Column 8, line 57, change "l,earings" to --bearings--.

Column 11, line 31, change "ivnerted" to --inverted--.

Column 11, line 57, change "eneral" to --general--.

Column 12, line 26, change "sid" to --said--.

Column 12, line 47, change "support means" to --saddle--.

UNITED STATES PATENT AND TRADEMARK OFFICE

CERTIFICATE OF CORRECTION

PATENT NO. : 5,135,190

DATED : August 4, 1992

INVENTOR(S) : Robert W. Wilson

It is certified that error appears in the above-indentified patent and that said Letters Patent is hereby corrected as shown below:

Column 12, line 49, change "support means" to --saddle--.

Column 12, line 54, change "support means" to --saddle--.

Signed and Sealed this

Twenty-sixth Day of October, 1993

*Attest:*

*Attesting Officer*

BRUCE LEHMAN

*Commissioner of Patents and Trademarks*